US006902139B2

(12) United States Patent
Wang

(10) Patent No.: US 6,902,139 B2
(45) Date of Patent: Jun. 7, 2005

(54) DETACHABLE FOLDING CLOTHESHORSE

(75) Inventor: Chi-Chung Wang, Kaohsiung Hsien (TW)

(73) Assignee: Chi Yu Steel Co., Ltd., Kaohsiung Hsien (TW)

( * ) Notice: Subject to any disclaimer, the term of this patent is extended or adjusted under 35 U.S.C. 154(b) by 3 days.

(21) Appl. No.: 10/705,324

(22) Filed: Nov. 10, 2003

(65) Prior Publication Data

US 2005/0098690 A1 May 12, 2005

(51) Int. Cl.[7] ..... A47F 5/00
(52) U.S. Cl. ..... 248/122.1; 248/306; 211/196
(58) Field of Search ..... 248/121, 165, 248/307, 308, 122.1; 211/196, 197, 204, 211/205; 223/89, 90; 428/8, 20

(56) References Cited

U.S. PATENT DOCUMENTS 88,739 A * 4/1869 Reichenbach ..... 108/31
353,332 A * 11/1886 Tremble ..... 211/171
796,676 A * 8/1905 Rogers ..... 211/96
843,712 A * 2/1907 Straus ..... 211/197
882,277 A * 3/1908 Teipel ..... 211/100
896,990 A * 8/1908 Hill ..... 248/125.3
5,845,414 A * 12/1998 Ohsugi ..... 34/239

* cited by examiner

*Primary Examiner*—Korie H. Chan
(74) *Attorney, Agent, or Firm*—Alan D. Kamrath; Nikolai & Mersereau, P.A.

(57) ABSTRACT

A detachable folding clotheshorse includes a seat with a top side, a bottom side and an outer periphery. The seat has a plurality of slots defined through the seat from the top side to the bottom. A notch is defined at the outer periphery of the seat. A supporting edge is formed beneath the notch. Two protrusions are formed at two inner walls of the slot adjacent the notch. A plurality of arms is respectively and pivotally mounted in the slots. Each of the arms has two channels longitudinally and respectively defined at two sides facing the protrusions. Two openings are respectively defined at top-rear ends of the channel for access of the protrusion to the channel. Whereby, the arms can be quickly and easily attached to and detached from the seat.

10 Claims, 8 Drawing Sheets

DETACHABLE FOLDING CLOTHESHORSE

BACKGROUND OF THE INVENTION

1. Field of the Invention

The present invention relates to a clotheshorse, and more particularly a folding clotheshorse which can be assembled or disassembled quickly and easily.

2. Description of Related Art

A conventional folding clotheshorse has a seat with a plurality of slots, and a plurality of arms respectively and pivotally mounted in the slots. The seat can be directly attached to a clothes rod. When not in use, the arms can be pivoted upwards to fold the clotheshorse for reducing the size of the clotheshorse. In use, the arms are pivoted downwards for airing wet clothes.

The conventional folding clotheshorse has the following shortcomings:

1. Because the arms are pivotally mounted in the slots and a user must detach the arms from the seat with a great effort, it is inconvenient to replace these arms with other types of arms.

2. When exposed to sunshine for a long time, the clotheshorse made of plastic material will deform and become brittle whereby the useful life of the clotheshorse is short. Thus, when not in use, the clotheshorse should be put in a room and shielded from sunlight. However, because it is difficult to detach the arms, the non-collapsed clotheshorse with a large overall size will occupy a great amount of space.

3. Even if folded, the arms are not positioned or fastened, so they still will be freely pivoted downwards by the users who do not exercise enough care.

Therefore, the invention provides a detachable folding clotheshorse to mitigate or obviate the aforementioned problems.

SUMMARY OF THE INVENTION

The main objective of the present invention is to provide a folding clotheshorse which can be quickly and easily detached for storing.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
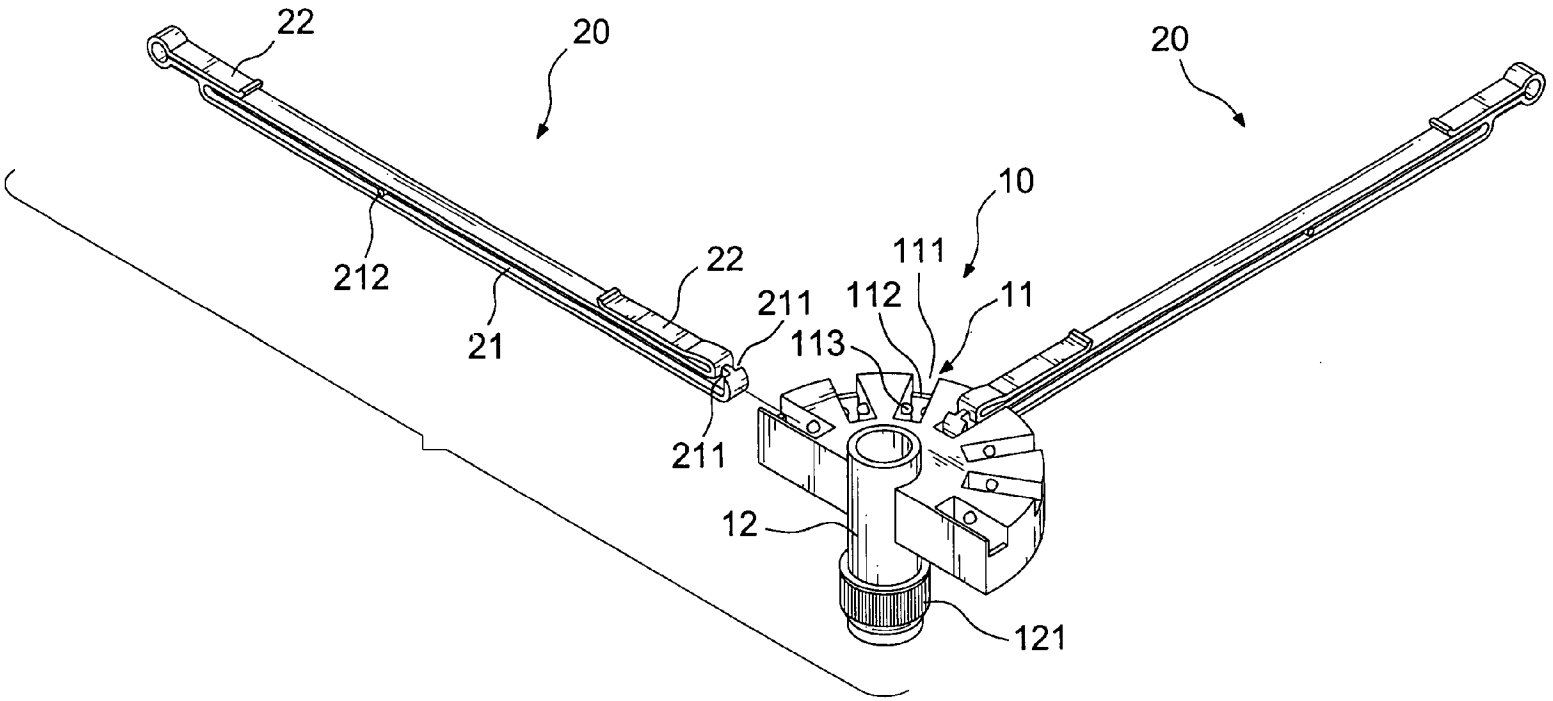
FIG. 1 is an exploded perspective view of a detachable folding clotheshorse in accordance with the invention.
Figure 2:
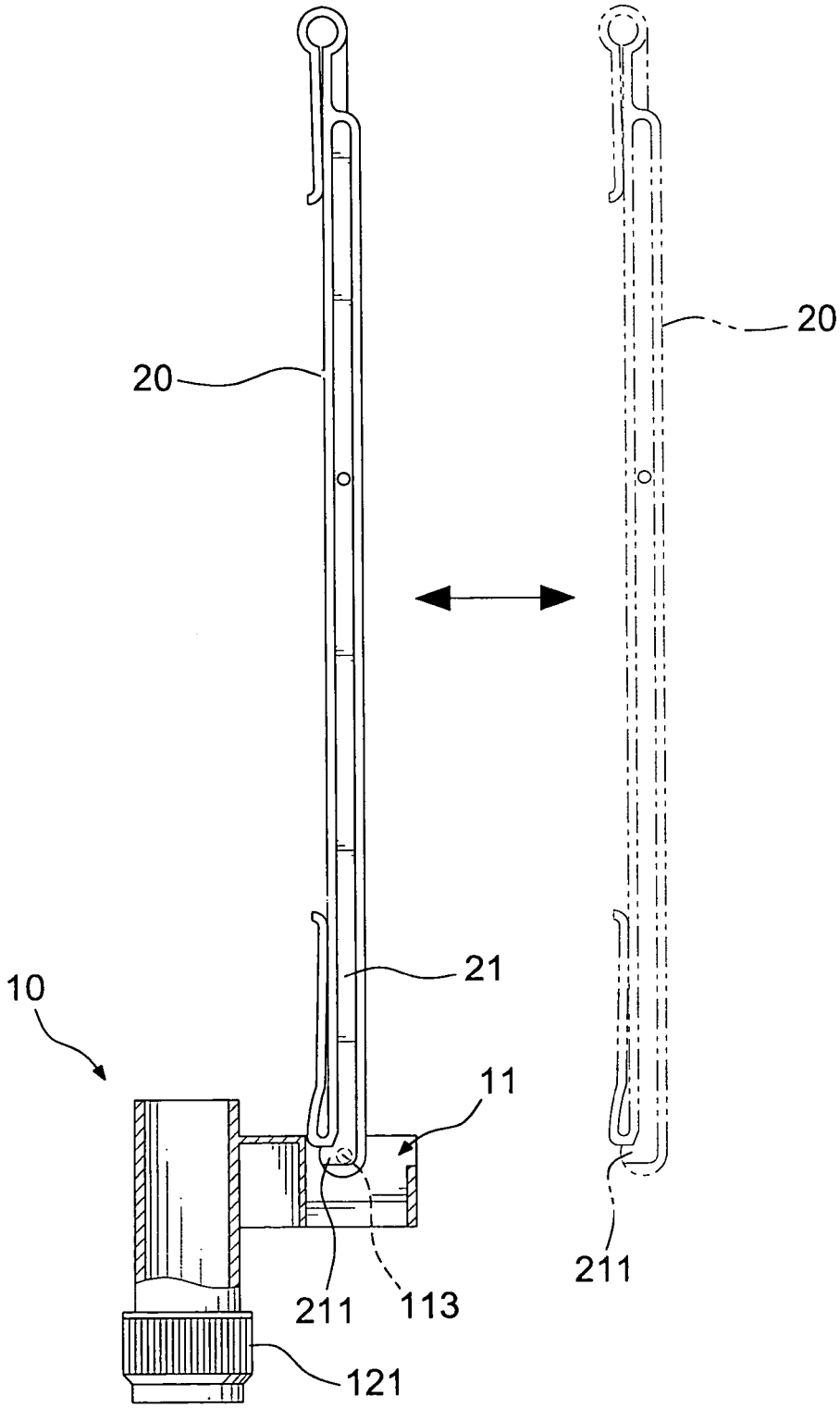
FIG. 2 is a schematic view showing a first step of assembling an arm in a seat of the clotheshorse in FIG. 1.
Figure 3:
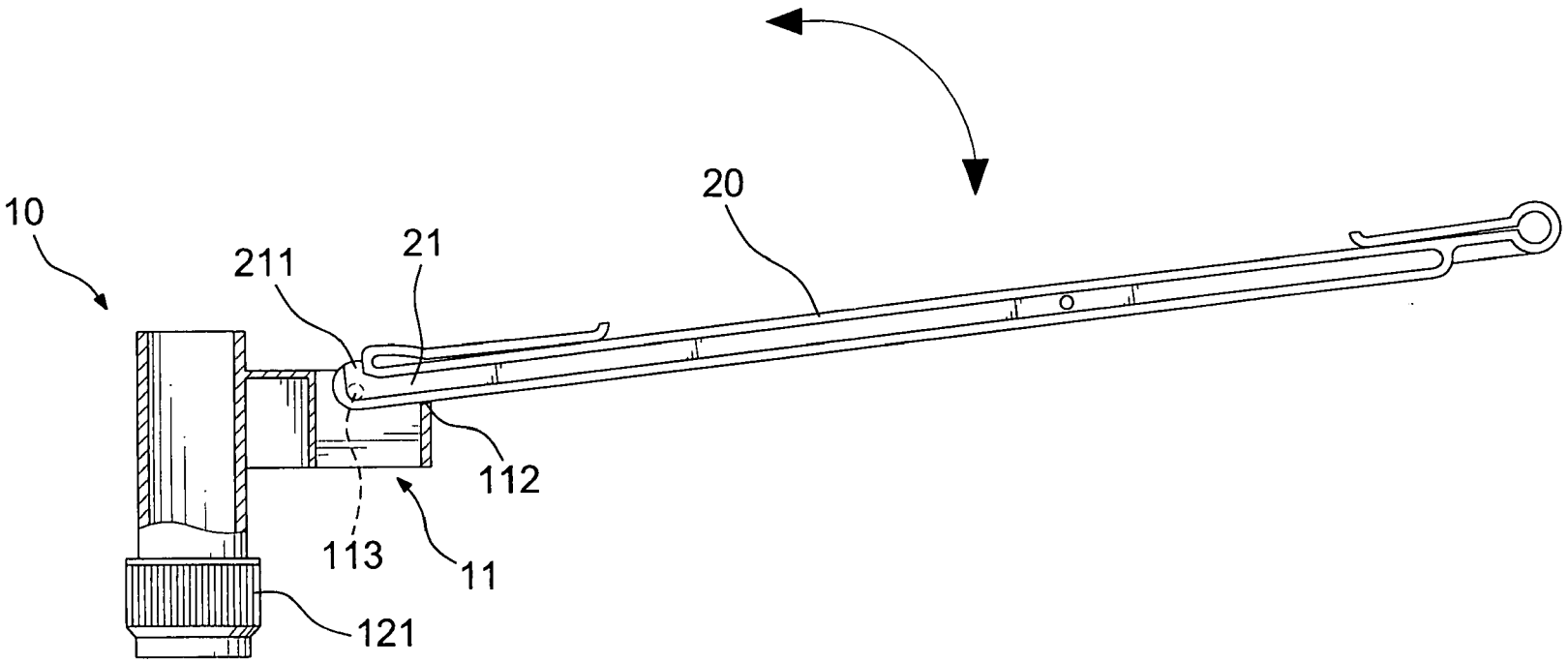
FIG. 3 is a schematic view showing a second step of assembling the arm in the seat of the clotheshorse in FIG. 1.

With reference to FIGS. 1–3, a clotheshorse in accordance with the invention is composed of a seat (10) and a plurality of arms (20).

The seat (10), with a top side, a bottom side and an outer periphery, has a plurality of slots (11) defined therethrough from the top side to the bottom side, and separately arranged along radial directions of the seat (10). The seat (10) can have a semi-circular, circular, or polygonal cross section. In this embodiment, the cross section of the seat (10) is semi-circular.

Each of the slots (11) has a notch (111) defined at the outer periphery of the seat (10), a supporting edge (112) formed beneath the notch (111), and at least one protrusion (113) formed at an inner wall adjacent the notch (111). In this embodiment, each of the slots (11) has two protrusions (113) respectively formed at two opposed inner walls adjacent the notch (111), as specially shown in FIG. 4.

With reference back to FIGS. 1–3, the seat (10) is securely mounted on a tube (12), and an adjusting connector (121) is provided at a lower end of the tube (12).

The arms (20) are respectively and pivotally mounted in the slots (11) of the seat (10). Each of the arms (20) has at least one channel (21) longitudinally defined at a side of the arm (20) facing the at least one protrusion (113) of the respective slots (11). In this embodiment, the arm (20) has two channels (21) respectively defined at two sides thereof and corresponding to the two protrusions (113). The channels (21) each have an opening (211) defined at a rear-top end thereof, and a stop (212) formed at a middle portion thereof. Two clips (22) are formed on a top side and respectively at a front and rear ends of the arm (20) for fastening clothes.

Figure 4:
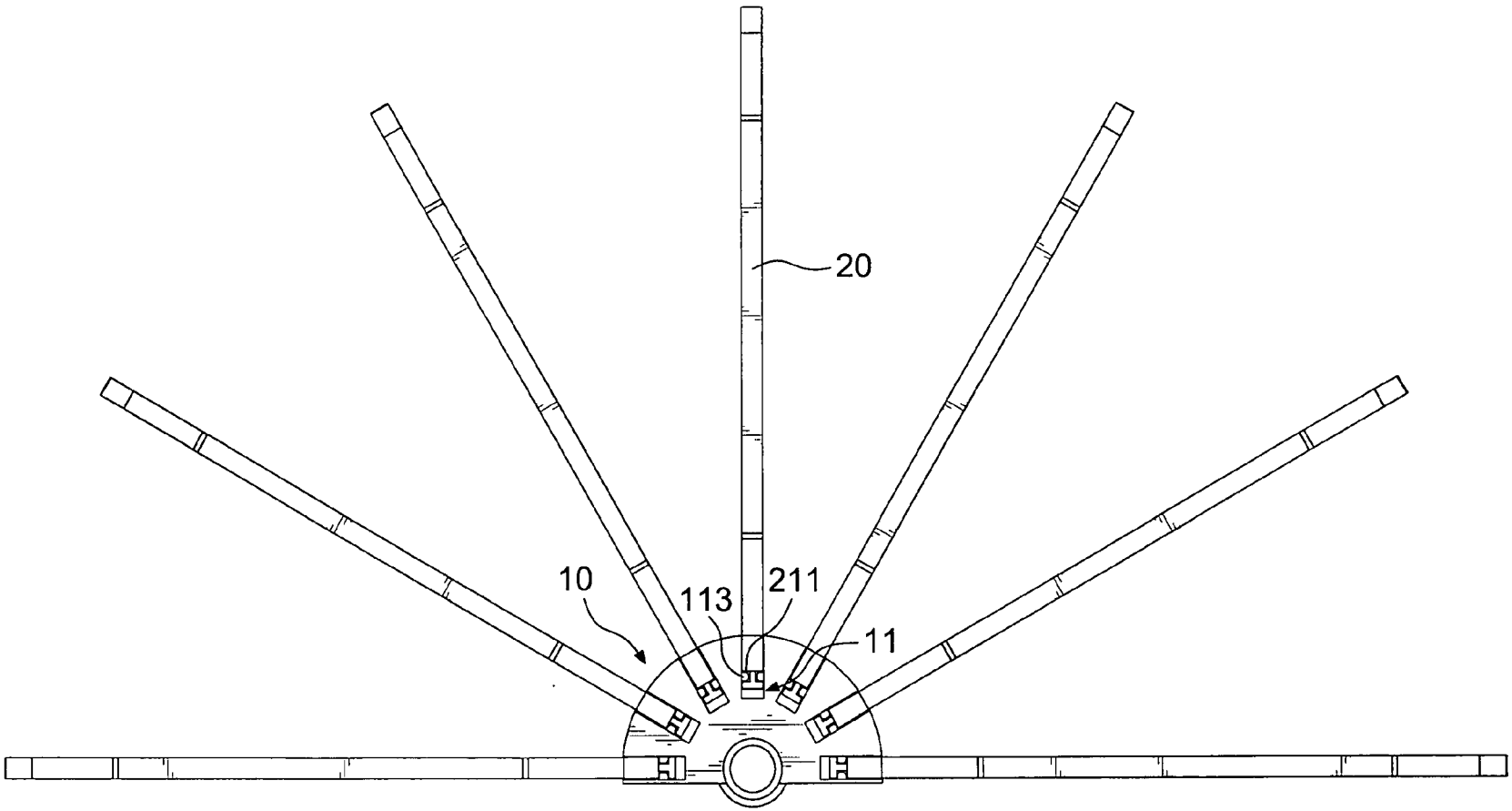
FIG. 4 is a top view of the clotheshorse in FIG. 1.

With reference to FIG. 2, in assembling, the arm (20) is uprightly inserted into the slot (11) with the two protrusions (113) respectively passing through the openings (211) and entering into the channels (21). With reference to FIGS. 3–4, therefore, the arm (20) can be pivoted downwards about the protrusions (113) received in the channels (21). When the arm (20) is in a substantially horizontal position, a bottom side of the arm (20) abuts the supporting edge (112) of the seat (10), so the arm (20) is positioned in the slot (11).

Figure 5:
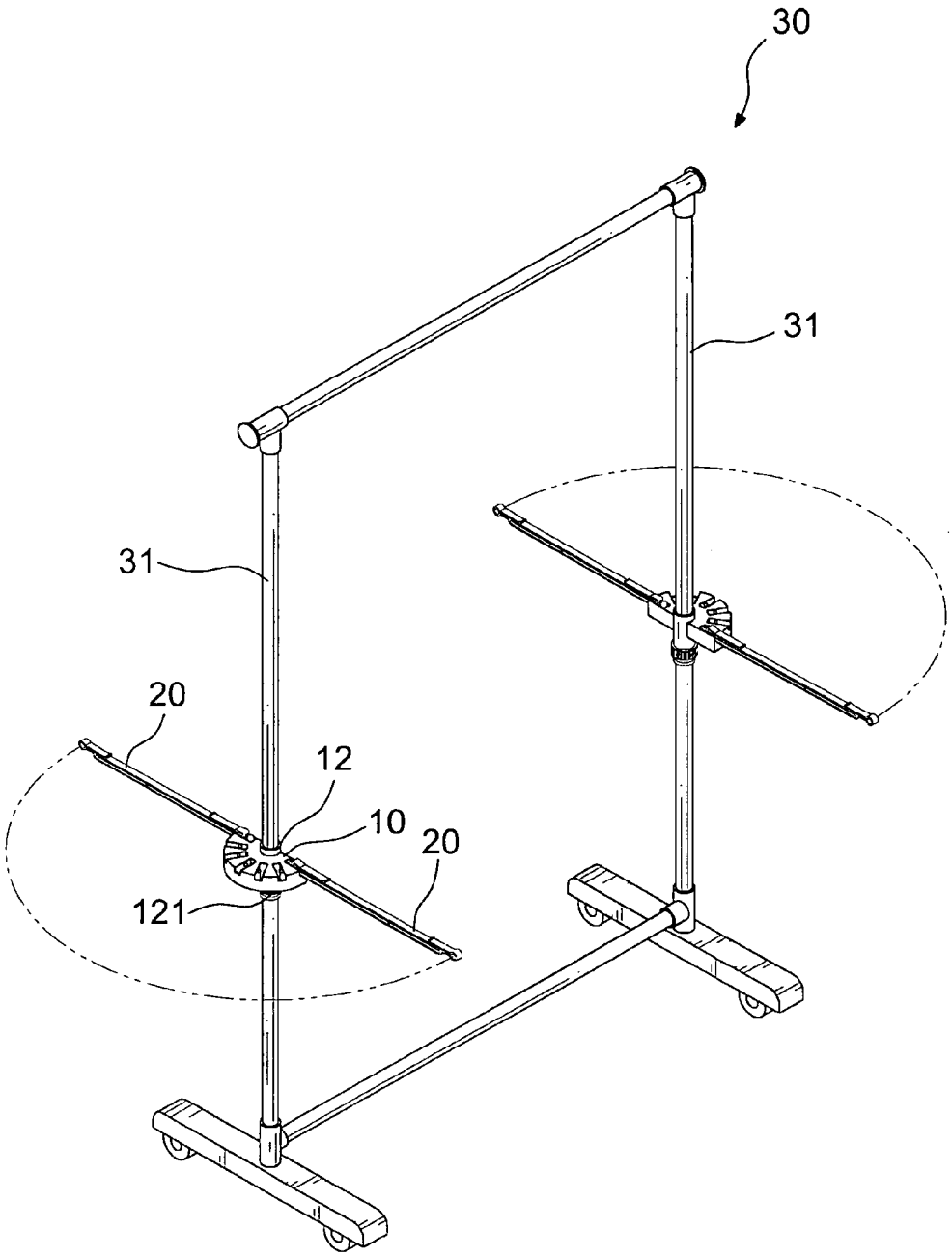
FIG. 5 is a schematic view of the clotheshorse being attached to a clothes-airing frame.

The clotheshorse of the invention can be directly hung on a clothes bar in a terrace. Otherwise, with reference to FIG. 5, the clotheshorse is installed on a clothes-airing frame (30) by fastening the tube (12) of the seat (10) on a post (31) of the clothes-airing frame (30). The adjusting connector (121) is tightened to secure the seat (10) on the post (31). When the arms (20) are extended, clothes can be hung on the arms (20) and gripped by the clips (22) for airing.

Figure 6:
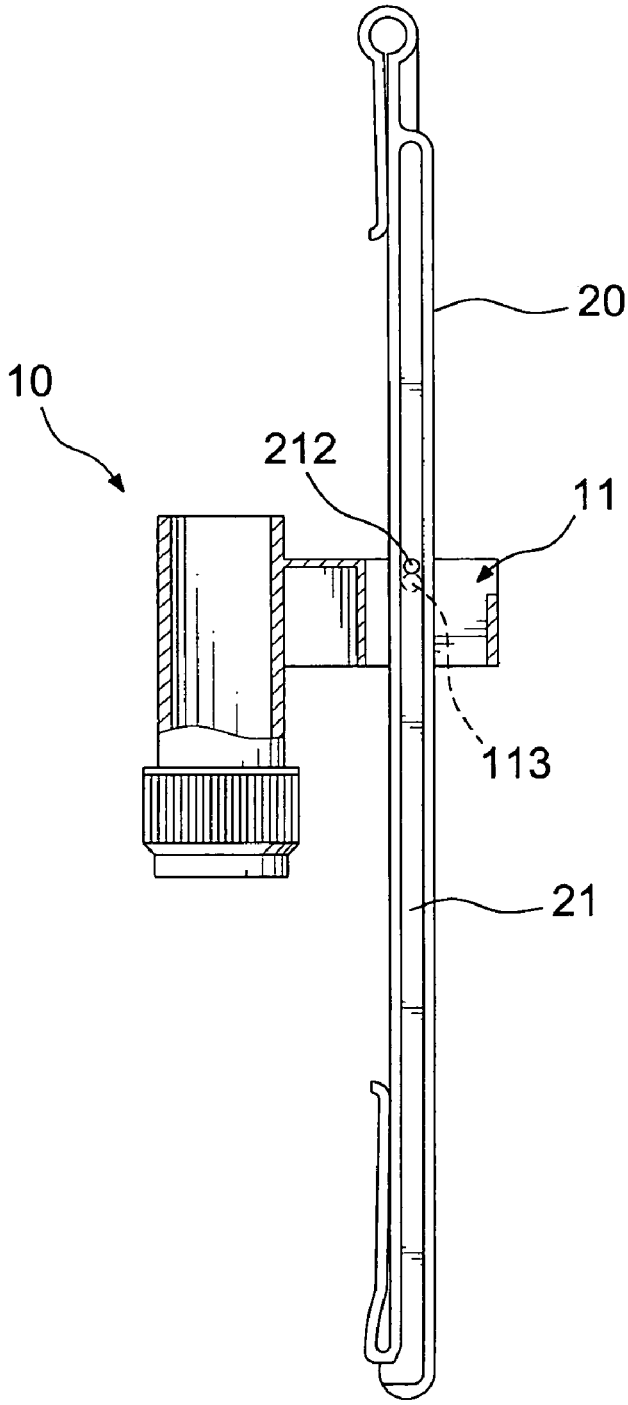
FIG. 6 is a schematic view showing the arm being moved downwards.

When not in use, with reference to FIGS. 3 and 6, the arm (20) can be pivoted upwards from the extended position to the upright position, and moved downwards until the stops (212) abut the respective protrusions (113) to reduce the size of the clotheshorse. In the folded status, it is impossible to freely pivot downwards the arms (20) even if a user touches the arms (20) unintentionally.

In detaching the arms (20), with reference to FIGS. 2 and 3, the arm (20) is first pivoted upwards to the upright position to align the protrusions (113) with the openings (211), and moved transversally to disengage the protrusions (113) from the channels (21). Thus, the arm (20) is detached from the seat (10).

Figure 7:
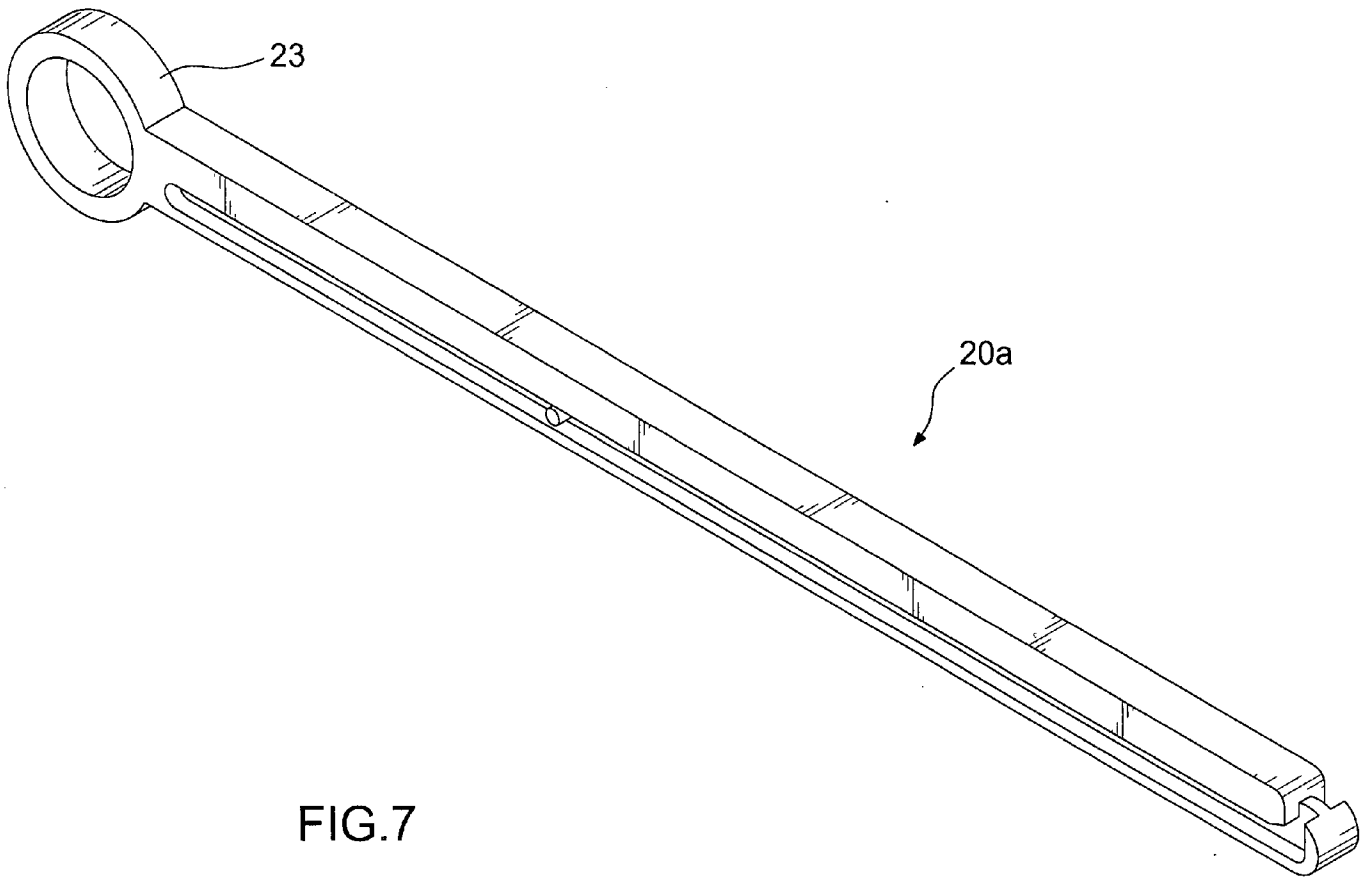
FIG. 7 is a perspective view of another embodiment of the arm in accordance with the invention.
Figure 8:
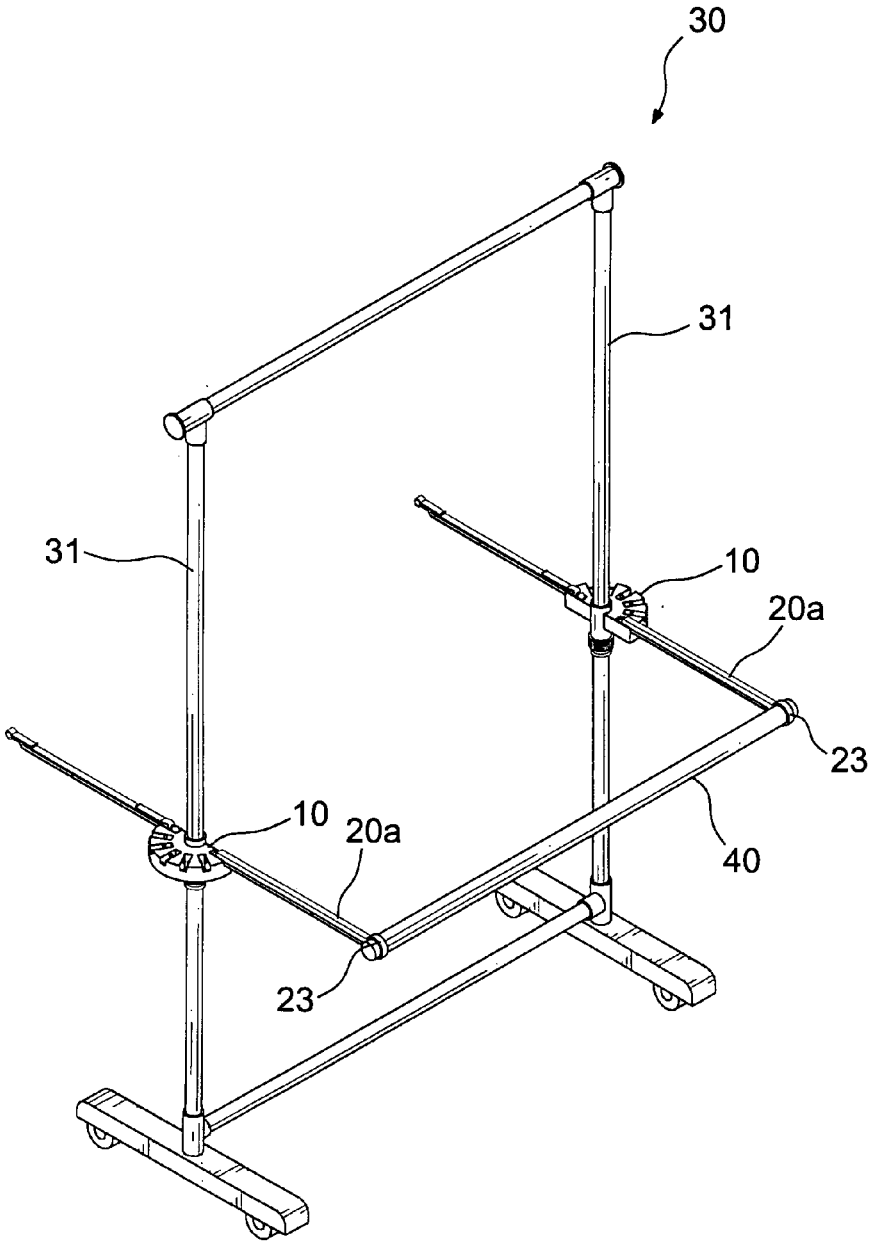
FIG. 8 is a schematic view showing the clotheshorse with the arms in FIG. 7 being attached to the clothes-airing frame.

With reference to FIGS. 7–8, in another embodiment of the present invention, the arm **(20*a*) has a ring (23) formed at the front end thereof. When two clotheshorses of the invention are mounted on the clothes-airing frame, a clothes bar (40) or a clothesline (not shown) can be attached between two opposed rings (23) of the two arms (20***a*) for hanging more clothes.

Therefore, the clotheshorse of the invention has the following advantages:

1. It is very convenient and easy to attach and detach the arms to/from the seat, so the user can quickly install the arms with or without the ring to use the clotheshorse according to the user's demands.

2. Because it is very simple and easy to detach the arms, the clotheshorse can be quickly disassembled for storing.

3. The arms can be folded in the seat when the clotheshorse is not in use.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A detachable folding clotheshorse comprising:

a seat with a top side, a bottom side and an outer periphery, the seat having a plurality of slots defined through the seat from the top side to the bottom side, and each slot having a notch defined at the outer periphery, a supporting edge formed beneath the notch, and two protrusions respectively formed at two opposed inner walls of the slot and adjacent the notch; and a plurality of arms respectively and pivotally mounted in the slots, each arm having two channels longitudinally defined at opposed sides respectively facing the protrusions for respectively receiving the protrusions and two openings defined at top-rear ends of the respective channel for access of the protrusions to the channels.

2. The detachable folding clotheshorse as claimed in claim 1, wherein each arm has two clips formed at a top side of the arm and respectively at a front end and a rear end of the arm.

3. The detachable folding clotheshorse as claimed in claim 1, wherein each arm has a ring formed at the front end of the arm.

4. The detachable folding clotheshorse as claimed in claim 1, wherein the seat is secured on a tube, and the tube has an adjusting connector provided at a lower end of the tube.

5. The detachable folding clotheshorse as claimed in claim 1, wherein the seat has a semi-circular cross-section, and the slots are separately defined and arranged along a radial direction of the seat.

6. A detachable folding clotheshorse comprising:

a seat with a top sides a bottom side and an outer periphery, the seat having a plurality of slots defined through the seat from the top side to the bottom side, and each slot having a notch defined at the outer periphery, a supporting edge formed beneath the notch, and at least one protrusion formed at an inner wall of the slot adjacent the notch; and a plurality of arms respectively and pivotally mounted in the slots, each arm having at least one channel longitudinally defined at a side facing the at least one protrusion for receiving the protrusion and at least one opening defined at a top-rear end of the channel for access of the protrusion to the channel, wherein each arm has a stop formed at a middle portion of the at least one channel.

7. The detachable folding clotheshorse as claimed in claim 6, wherein each arm has two clips formed at a top side of the arm and respectively at a front end and a rear end of the arm.

8. The detachable folding clotheshorse as claimed in claim 6, wherein each arm has a ring formed at the front end of the arm.

9. The detachable folding clotheshorse as claimed in claim 6, wherein the seat is secured on a tube, and the tube has an adjusting connector provided at a lower end of the tube.

10. The detachable folding clotheshorse as claimed in claim 6, wherein the seat has a semi-circular cross-section, and the slots are separately defined and arranged along a radial direction of the seat.

* * * * *